US009343251B2

(12) United States Patent
Juds et al.

(10) Patent No.: US 9,343,251 B2
(45) Date of Patent: May 17, 2016

(54) BI-DIRECTIONAL DIRECT CURRENT ELECTRICAL SWITCHING APPARATUS INCLUDING SMALL PERMANENT MAGNETS ON FERROMAGNETIC SIDE MEMBERS AND ONE SET OF ARC SPLITTER PLATES

(71) Applicant: EATON CORPORATION, Cleveland, OH (US)

(72) Inventors: Mark Allan Juds, New Berlin, WI (US); Xin Zhou, Franklin Park, PA (US); Amogh Vilas Kank, Dombivli (IN); Paul Jason Rollmann, Menomonee Falls, WI (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/066,913

(22) Filed: Oct. 30, 2013

(65) Prior Publication Data

US 2015/0114934 A1 Apr. 30, 2015

(51) Int. Cl.

*H01H 33/08* (2006.01)
*H01H 9/36* (2006.01)
*H01H 9/44* (2006.01)

(52) U.S. Cl.

CPC ..... *H01H 33/08* (2013.01); *H01H 9/36* (2013.01); *H01H 9/443* (2013.01)

(58) Field of Classification Search

CPC ..... H01H 9/44; H01H 9/443; H01H 9/34; H01H 9/342; H01H 9/36; H01H 33/02; H01H 33/08; H01H 33/182
USPC ..... 218/22, 23, 26, 81, 149, 151, 156, 34; 335/201
See application file for complete search history.

(56) References Cited

U.S. PATENT DOCUMENTS 4,375,021 A 2/1983 Pardini et al.
4,743,720 A 5/1988 Takeuchi et al.

(Continued)

FOREIGN PATENT DOCUMENTS

DE 10 07 409 B 5/1957
DE 11 40 997 B 12/1962

(Continued)

OTHER PUBLICATIONS

FR2632772—Machine translation (original document published Dec. 15, 1989).*

(Continued)

*Primary Examiner* — Renee Luebke
*Assistant Examiner* — William Bolton
(74) *Attorney, Agent, or Firm* — Eckert Seamans Cherin & Mellott, LLC; Brij K. Agarwal; Grant E. Coffield

(57) ABSTRACT

An electrical switching apparatus for bi-directional direct current switching and interruption includes separable contacts, an operating mechanism to open and close the contacts, and an arc chute. The arc chute includes two ferromagnetic side members each having a first side and an opposite second side, the first side of a second ferromagnetic side member facing the first side of a first ferromagnetic side member, a first permanent magnet disposed on the first side of the first side member, a second permanent magnet disposed on the first side of the second side member, and a single set of a plurality of arc splitter plates disposed between the permanent magnets. The permanent magnets are substantially smaller in size than each of the side members. The arc chute is divided into two arc chambers each of which is for a corresponding direction of DC flow through the contacts.

20 Claims, 10 Drawing Sheets

(56) References Cited

U.S. PATENT DOCUMENTS

| | | | | |
|---|---|---|---|---|
| 5,004,874 | A | 4/1991 | Theisen et al. | |
| 5,130,504 | A | 7/1992 | Moldovan et al. | |
| 5,818,003 | A * | 10/1998 | Moldovan | H01H 9/443 218/26 |
| 7,541,902 | B2 | 6/2009 | Domejean et al. | |
| 7,679,020 | B2 | 3/2010 | Schulz et al. | |
| 7,839,243 | B1 | 11/2010 | Chen et al. | |
| 7,915,985 | B2 * | 3/2011 | Schmitz et al. | 335/201 |
| 8,222,983 | B2 * | 7/2012 | Zhou et al. | 335/201 |
| 2005/0150870 | A1 | 7/2005 | Schneider et al. | |
| 2009/0127229 | A1 | 5/2009 | Schmitz et al. | |

FOREIGN PATENT DOCUMENTS

| | | | | |
|---|---|---|---|---|
| DE | 12 46 851 | B | 8/1967 | |
| DE | 20 2005 007878 | U1 | 9/2006 | |
| EP | 1 548 772 | A1 | 6/2005 | |
| EP | 2 701 170 | A1 | 2/2014 | |
| FR | 2632772 | * | 12/1989 | H01H 9/443 |
| GB | 1 509 146 | A1 | 4/1978 | |
| WO | 2014/039162 | A1 | 3/2014 | |

OTHER PUBLICATIONS

Siemens Industry, Inc., "Heavy Duty Photovoltaic Disconnect Switches", www.usa.siemens.comiswitches, 2010, 4pp.

Tyco Electronics, "Kilovac EV250-1A & 1B-400 Amps ("Czonka II EVX")", www.tycoelectronics.com, 2010, pp. 16 and 19.

United Kingdom Intellectual Property Office (UKIPO), "Prior Art Search for GB 2521731", Apr. 23, 2015, 1 p.

* cited by examiner

BI-DIRECTIONAL DIRECT CURRENT ELECTRICAL SWITCHING APPARATUS INCLUDING SMALL PERMANENT MAGNETS ON FERROMAGNETIC SIDE MEMBERS AND ONE SET OF ARC SPLITTER PLATES

BACKGROUND

1. Field

The disclosed concept pertains generally to electrical switching apparatus and, more particularly, to bi-directional direct current electrical switching apparatus, such as, for example, circuit breakers including an arc chute.

2. Background Information

Electrical switching apparatus employing separable contacts exposed to air can be structured to open a power circuit carrying appreciable current. These electrical switching apparatus, such as, for instance, circuit breakers, typically experience arcing as the contacts separate and commonly incorporate arc chutes to help extinguish the arc. Such arc chutes typically comprise a plurality of electrically conductive plates held in spaced relation around the separable contacts by an electrically insulative housing. The arc transfers to the arc plates where it is stretched and cooled until extinguished.

Typically, molded case circuit breakers (MCCBs) are not specifically designed for use in direct current (DC) applications. When conventional alternating current (AC) MCCBs are sought to be applied in DC applications, multiple poles are electrically connected in series to achieve the required interruption or switching performance based upon the desired system DC voltage and system DC current.

One of the challenges in DC interruption is to drive the arc into the arc interruption chamber, specifically at relatively low current levels. Some existing DC switching devices use permanent magnets to drive the arc into the arc splitter plates. However, they either provide only uni-directional current interruption, or they are relatively large due to the use of two separate arc chambers in order to achieve bi-directional performance.

There is room for improvement in bi-directional direct current electrical switching apparatus.

SUMMARY

These needs and others are met by embodiments of the disclosed concept in which an electrical switching apparatus is for bi-directional direct current switching and interruption. The electrical switching apparatus comprises: separable contacts; an operating mechanism structured to open and close the separable contacts; and an arc chute comprising: a first ferromagnetic side member having a first side and an opposite second side, a second ferromagnetic side member having a first side and an opposite second side, the first side of the second ferromagnetic side member facing the first side of the first ferromagnetic side member, a first permanent magnet disposed on the first side of the first ferromagnetic side member, a second permanent magnet disposed on the first side of the second ferromagnetic side member, and a single set of a plurality of arc splitter plates disposed between the first and second permanent magnets, wherein the first and second permanent magnets are substantially smaller in size than each of the first and second ferromagnetic side members, wherein the arc chute is divided into two arc chambers, and wherein each of the two arc chambers is for a corresponding direction of direct current flow through the separable contacts.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

The disclosed concept employs a permanent magnet arrangement and a single break contact structure to achieve bi-directional direct circuit (DC) switching and interruption capability, including at relatively low current levels. This improves the orientation of the magnetic field which drives an arc into one of two arc chambers (depending on the DC current direction) and splits the arc.

Figure 1:
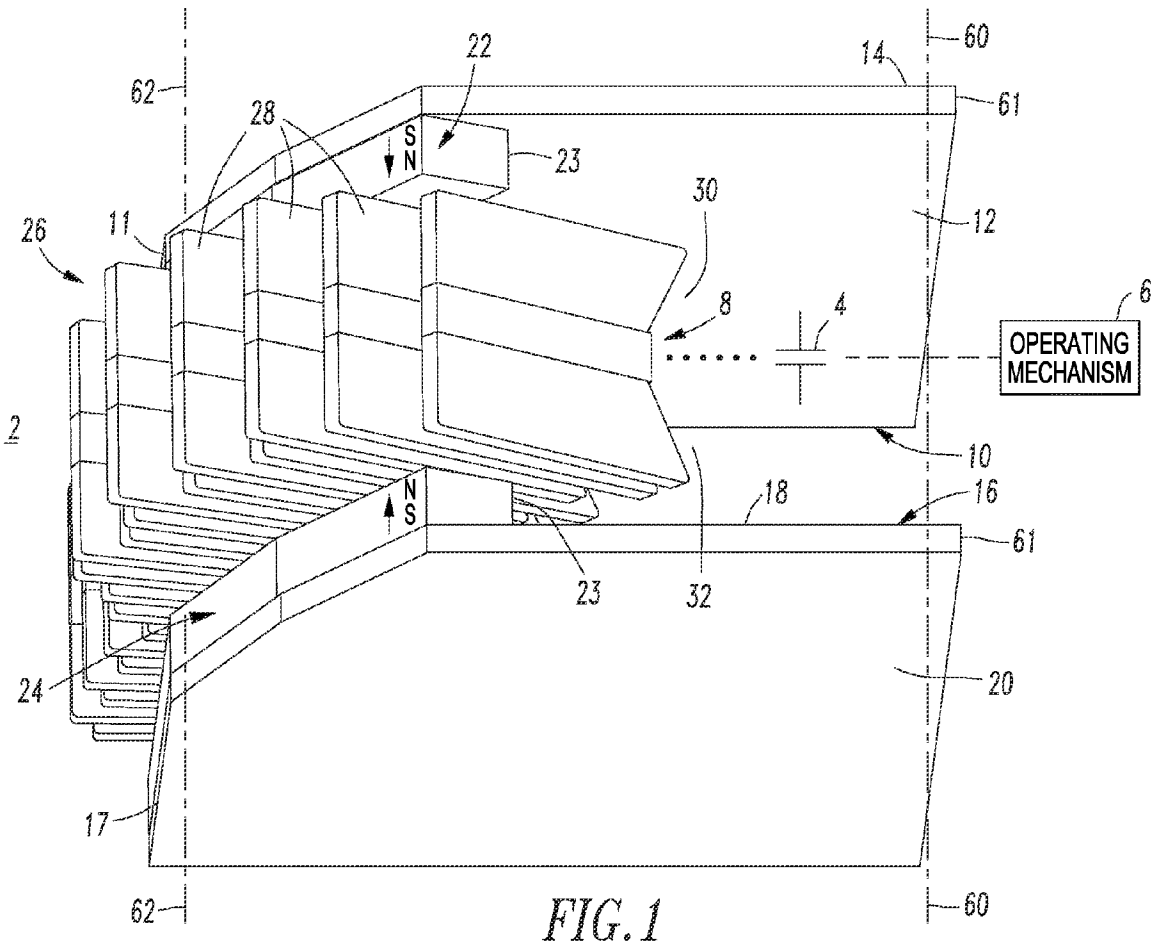
FIG. 1 is an isometric view of a circuit breaker arc chute including relatively small permanent magnets on ferromagnetic side walls and one set of arc splitter plates in accordance with embodiments of the disclosed concept.
Figure 2A:
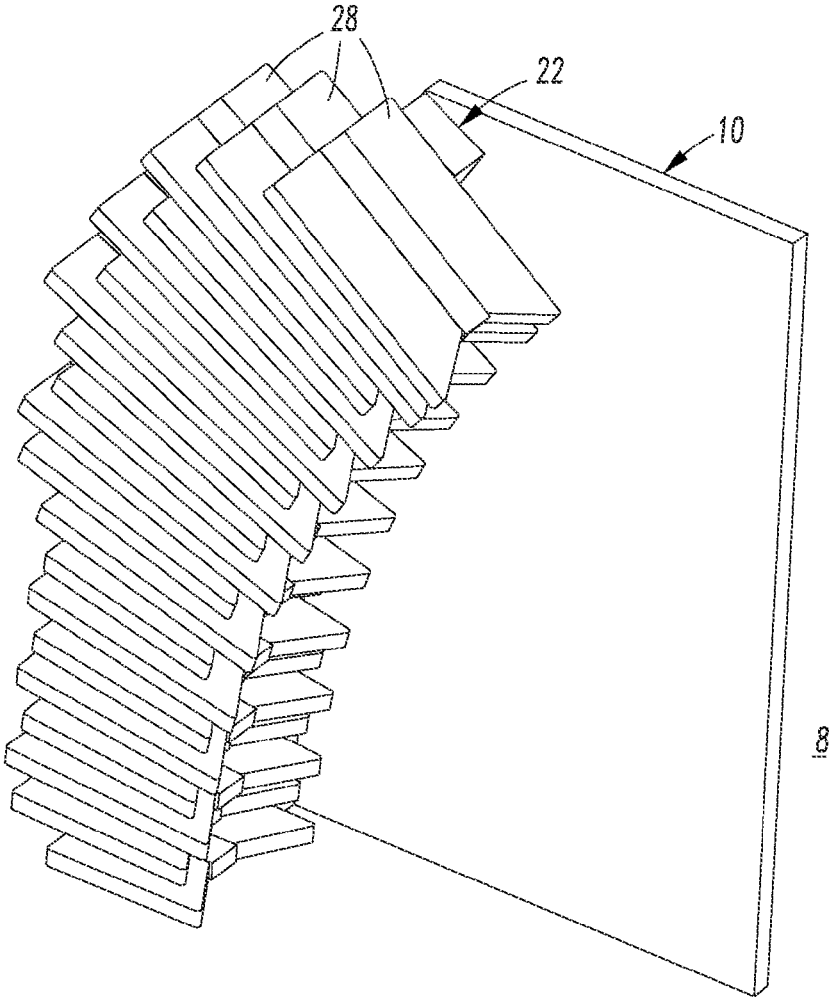
FIG. 2A is an isometric view of a portion of the arc chute of FIG. 1 in which the arc splitter plates are non-magnetic arc splitter plates.
Figure 2B:
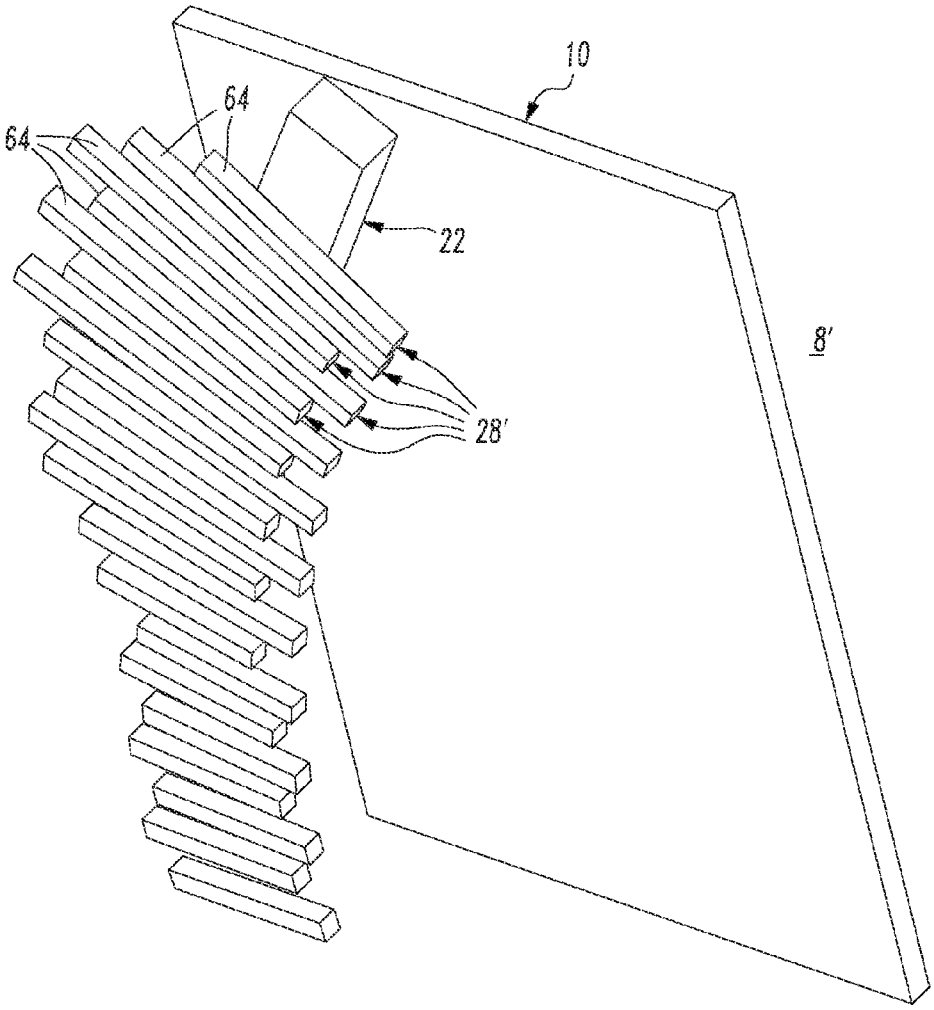
FIG. 2B is an isometric view of a portion of another arc chute including one of two permanent magnets, one of two ferromagnetic side walls, and a magnetic portion of a plurality of composite arc splitter plates in accordance with an embodiment of the disclosed concept.

Referring to FIG. 1, an electrical switching apparatus, such as the example circuit breaker 2, is for bi-directional DC switching and interruption. The circuit breaker 2 includes separable contacts 4, an operating mechanism 6 structured to open and close the separable contacts 4, and an arc chute 8. In this example, the separable contacts 4 are a single break contact structure. The arc chute 8 includes a first ferromagnetic (e.g., without limitation, steel) side member 10 having a first side 12 and an opposite second side 14, and a second ferromagnetic (e.g., without limitation, steel) side member 16 having a first side 18 and an opposite second side 20. The first side 18 of the second ferromagnetic side member 16 faces the first side 12 of the first ferromagnetic side member 10. A first permanent magnet 22 is disposed on the first side 12 of the first ferromagnetic side member 10, and a second permanent magnet 24 is disposed on the first side 18 of the second ferromagnetic side member 16. A single set 26 of a plurality of arc splitter plates 28 is disposed between the first and second permanent magnets 22,24, which are substantially smaller in size (as best shown in FIGS. 2A and 2B) than each of the first and second ferromagnetic side members 10,16. The arc chute 8 is divided into two arc chambers 30,32, each of which is for a corresponding direction of direct current flow through the separable contacts 4.

FIG. 2A shows a portion of the arc chute 8 of FIG. 1 including the ferromagnetic side member 10, the relatively small permanent magnet 22 and the arc splitter plates 28, which are made of a non-magnetic material.

Figure 7:
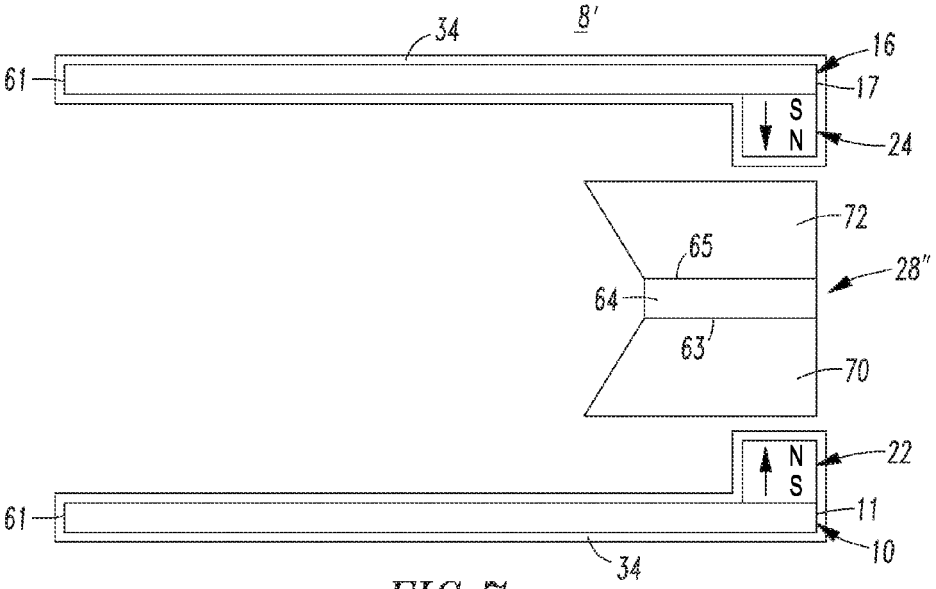
FIG. 7 is a simplified plan view of the arc chute of FIG. 2B.

FIG. 2B shows a portion of another arc chute 8' (as best shown in FIG. 7) including the first permanent magnet 22, the first ferromagnetic side member 10, and a magnetic portion 64 of a plurality of composite arc splitter plates 28".

As shown in FIG. 7, the first and second permanent magnets 22,24 and the first and second ferromagnetic side members 10,16 are covered with electrical insulation 34 to prevent shorting out the arc column. The ferromagnetic side members 10,16 and the permanent magnets 22,24 are electrically conductive and are electrically insulated to maintain the arc voltage and to achieve interruption. Otherwise, the arc electrical current will move into the electrically conductive ferromagnetic (e.g., without limitation, steel) and the permanent magnet materials and the arc voltage will significantly decrease and interruption will not be achieved.

Figure 6:
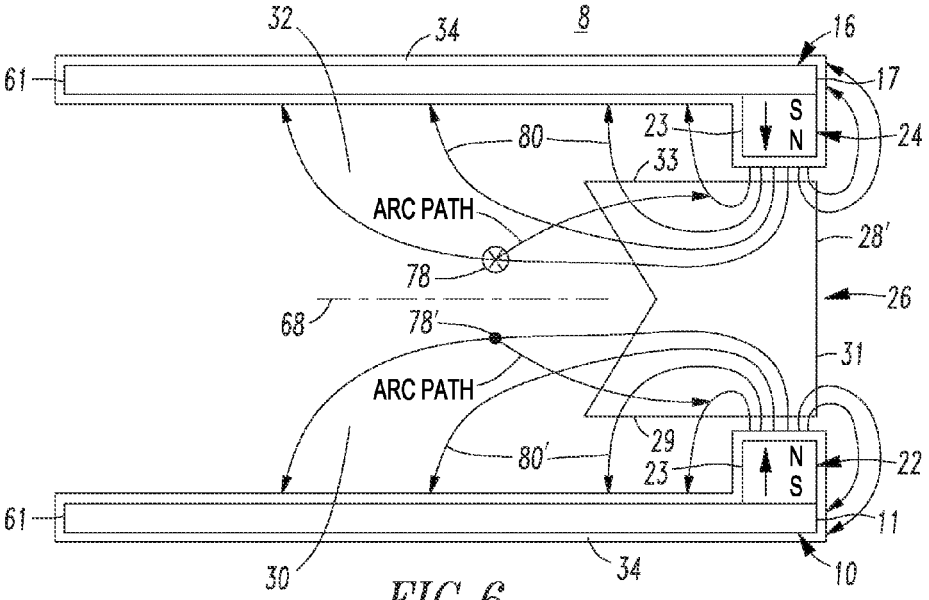
FIG. 6 is a simplified plan view of the arc chute of FIG. 2A.

The arc splitter plates 28 (FIG. 1) can be non-magnetic arc splitter plates 28' (FIG. 6) or can be composite arc splitter plates 28" (FIG. 7) with an intermediate magnetic (e.g., without limitation, made of magnetic steel; carbon steel) portion 64. The arc splitter plates 28' of FIG. 6 are non-magnetic; otherwise, the magnetic field from the first and second permanent magnets 22,24 will be significantly reduced in the region of the arc splitter plates 28'. It is important for the magnetic field in the arc splitter plate region to be large enough to move the arc into, split the arc and hold the arc in the splitter plates 28' to achieve current interruption. Alternatively, as shown in FIG. 7, the arc splitter plates 28" are made with the intermediate magnetic portion 64, which increases the magnetic field in the arc splitter plate region and on the closed separable contacts 4 (FIG. 1).

Figure 3:
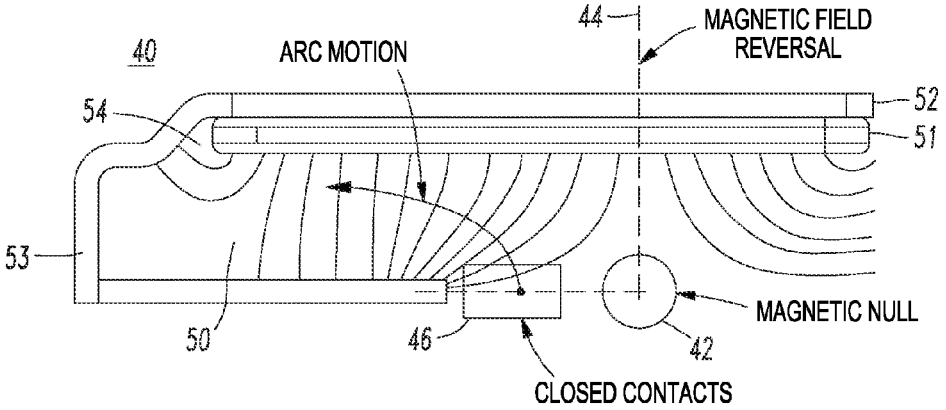
FIG. 3 PRIOR ART
FIG. 3 is a magnetic finite element analysis field plot for a prior straight ferromagnetic side wall and permanent magnet structure showing the location of a magnetic null point and a line of magnetic field reversal.

FIG. 3 shows a magnetic finite element analysis field plot 40 for a straight ferromagnetic side wall and a prior permanent magnet structure (not shown). The plot includes a location of a magnetic null point 42 and a line of magnetic field reversal 44. Here, the null point 42 and the field reversal 44 are relatively much closer to closed separable contacts 46 and arc splitter plates 50. During instances when the arc column size is too large at relatively high current levels, the arc could cross the null point 42 and enter the reversed field, which pulls the arc away from the arc splitter plates 50.

The relatively small (FIGS. 1 and 2A-2B) and relatively large (FIG. 3) permanent magnet configurations both have permanent magnets that direct the magnetic field into ferromagnetic side members. In FIG. 3, a relatively large permanent magnet 51 causes the magnetic field to go into a ferromagnetic side member 52, and come back into a contact region from a ferromagnetic material 53 on the left (with respect to FIG. 3) side and from air on the right (with respect to FIG. 3) side. Therefore, the magnetic null point 42 is where the fields meet. If the geometry was perfectly symmetrical, then the magnetic null point 42 would be in the center of the permanent magnet 51. However, the ferromagnetic material 53 causes the magnetic null point 42 to be slightly to the right of center (right of the closed separable contacts 46). There is also a second magnetic field reversal 54 (e.g., a relatively small loop of flux) at the left (with respect to FIG. 3) edge of the permanent magnet 51 which causes the arc to stop at that position, and which keeps the arc in the arc splitter plates 50 to maintain a relatively high arc voltage and to achieve current interruption.

Figure 4:
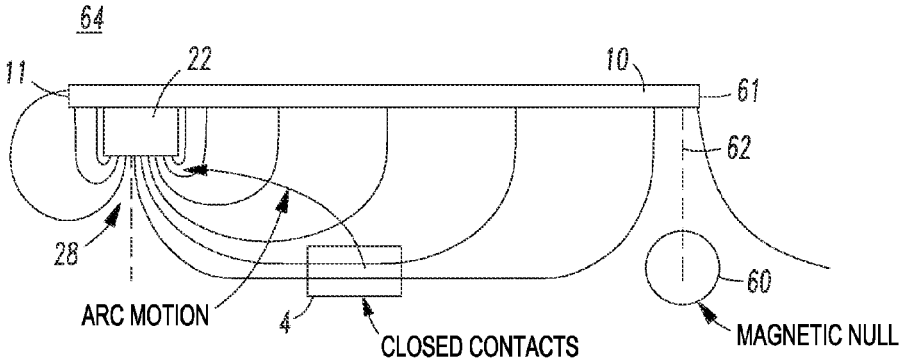
FIG. 4 is a magnetic finite element analysis field plot for the circuit breaker arc chute of FIG. 2A showing that the location of the magnetic null point and the line of magnetic field reversal are moved to the right with respect to the plot of FIG. 3.

FIG. 4 shows a magnetic finite element analysis field plot 64 for the arc chute 8 of FIG. 2A. The location of the magnetic null point 60 and the line of magnetic field reversal 62 are moved to the right with respect to FIG. 4. More specifically, the magnetic null point 60 and the magnetic field reversal 62 are disposed apart from the closed separable contacts 4 and are disposed further apart from the arc splitter plates 28. The permanent magnets 22,24 (FIG. 1) form the magnetic field and force the magnetic field null point 60 and the magnetic field reversal 62 away from the arc splitter plates 28, and increase a magnitude of the magnetic field proximate the closed separable contacts 4. The magnetic field pulls an arc struck between the separable contacts 4 when moving from a closed position thereof toward an open position thereof toward the arc splitter plates 28 regardless of an initial direction of motion of the arc.

Referring again to FIG. 1, the permanent magnets 22,24 cause the magnetic field to enter one of the respective ferromagnetic side members 10,16 and come back into a region of the closed separable contacts 4 from air on one side and from the other ferromagnetic side member 10 or 16 on the other side. The permanent magnets 22,24 are located at first edges 11,17 of the ferromagnetic side members 10,16, respectively, distal from the separable contacts 4. An extension of the ferromagnetic side members 10,16 toward the separable contacts 4 causes the magnetic field to be directed toward a corresponding one of the permanent magnets 22,24. The magnetic null point 60 (FIG. 4) is located about at an opposite second edge 61 of the ferromagnetic side members 10,16 distal from the separable contacts 4. The second magnetic field reversal 62 at about the first edges 11,17 of the ferromagnetic side members 10,16 causes an arc struck between the separable contacts 4 to stop at the first edges 11 or 17. The magnetic field is increased at about a side of the separable contacts 4 distal from the opposite second edge 61 of the ferromagnetic side members 10,16 in the closed position of the separable contacts 4. The magnetic field causes the arc to move toward the arc splitter plates 28.

The disclosed concept employs the relatively small permanent magnets 22,24 on the respective ferromagnetic side members 10,16 of the arc chute 8 forming the two arc chambers 30,32 and employs the arc splitter plates 28' that are non-magnetic (FIG. 6) or composite arc splitter plates 28" with the intermediate magnetic portion 64 (FIG. 7) to improve the magnitude and orientation of the magnetic field which drives the arc into the arc splitter plates 28,28',28". The improved magnetic field orientation forces the magnetic field null point and field reversal away from the arc chutes 8,8', and increases the magnitude of the magnetic field near the closed separable contacts 4 (FIG. 1) (e.g., where the arc is initiated as the contacts initially start to part). This allows the magnetic field to pull the arc toward the arc splitter plates 28,28',28" regardless of the initial arc motion direction.

The relatively small permanent magnets 22,24 of FIG. 1 cause the magnetic field to go into one of the ferromagnetic side members 10,16, and come back into the contact region from the air on the left (with respect to FIG. 1) side and from the ferromagnetic side member on the right (with respect to FIG. 1) side. The permanent magnets 22,24 are located at the left (with respect to FIG. 1) edges 11,17 of the ferromagnetic side members 10,16. Therefore, the ferromagnetic side members 10,16 extending to the right (with respect to FIG. 1) cause the magnetic field to be directed toward the permanent magnets 22,24 on the left (with respect to FIG. 1), and the magnetic null 60 is located almost at the right (with respect to FIG. 1) edge 61 of the ferromagnetic side members 10,16. There is also the second magnetic field reversal 62 (e.g., a relatively small loop of flux) at the left (with respect to FIG. 1) edges 11 or 17 of the permanent magnets 22 or 24, respectively, which causes the arc to stop at that position, and which keeps the arc in the splitter plates 28 to maintain a high arc voltage and to achieve current interruption.

The increased magnetic field is near the right side (with respect to FIG. 1) of the closed separable contacts 4. The magnetic null 60 causes the magnetic field magnitude to drop to zero, and the direction of the magnetic field is reversed to the right (with respect to FIG. 1) of the magnetic null 60. Therefore, if an arc is ignited at the right (with respect to FIG. 3) edge of the closed separable contacts 46, and the magnetic null 42 is close to the right (with respect to FIG. 3) edge of the closed separable contacts 46 (such as with the relatively large permanent magnet configuration of FIG. 3), then the arc will be in a very low magnitude magnetic field, where it can randomly move (due to other forces such as gas pressure, wall insulation outgassing pressure, chemical contamination on the contacts or conductor or wall insulation) to the right (with respect to FIG. 3) and into a region where the magnetic field forces the arc to move to the right away from the splitter plates 28 (with respect to FIG. 3), which is the wrong way. The relatively small permanent magnet configuration of FIG. 1 has a relatively very large region between the right edge of the closed separable contacts 4 and the magnetic null 60 in which the magnetic field causes the arc to move to the left (with respect to FIG. 1) toward the arc splitter plates 28.

Figure 5:
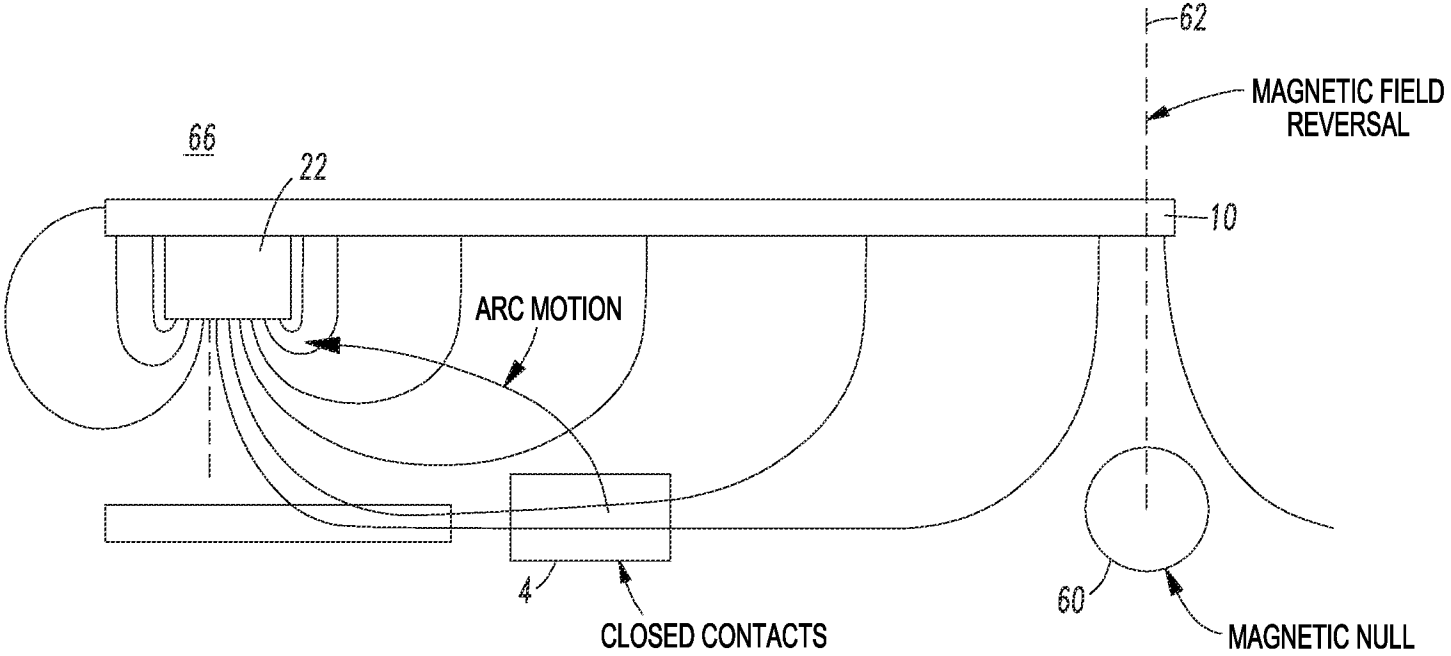
FIG. 5 is a magnetic finite element analysis field plot for the arc chute of FIG. 2B showing that the location of the magnetic null point and the line of magnetic field reversal are moved to the right with respect to the plot of FIG. 3.

FIG. 5 shows a magnetic finite element analysis field plot 66 for the arc chute 8' of FIG. 2B. The location of the magnetic null point 60 and the line of magnetic field reversal 62 are moved to the right with respect to FIG. 3.

FIG. 6 shows a simplified plan view of the arc chute 8 of FIG. 1 with the relatively small permanent magnets 22,24 on the respective ferromagnetic side members 10,16 and the non-magnetic (e.g., without limitation, copper; stainless steel) arc splitter plates 28'. The arc chute 8 further includes an insulative divider 68. The two arc chambers 30,32 are formed by the electrically insulative divider (e.g., without limitation, a relatively thin intermediate plastic divider) 68, which divides the single set 26 of the arc splitter plates 28' into the first arc chamber 30 and the adjacent second arc chamber 32. This confines the arc in the region where the magnetic field is orientated to hold the arc in the arc splitter plates 28'. If the arc is allowed to expand or drift across the center of the arc splitter plates 28', then it will experience a force to the left (with respect to FIG. 6) and away from the splitter plates 28' (with respect to FIG. 6), which is the wrong direction.

A first polarity arc 78 interacts with the magnetic field 80 in FIG. 6 to move toward the arc splitter plate 28'. An opposite second polarity arc 78' interacts with the magnetic field 80' to move toward the arc splitter plate 28'.

The arc splitter plates 28' are made of a non-magnetic material (e.g., without limitation, copper; a non-magnetic stainless steel, such as austenitic stainless steel). In FIG. 6, there is no vertical steel plate in the center of the arc splitter plates 28'. There can be the example electrically insulative divider 68 or no insulator at all. The permanent magnets 22,24 are as wide and as thick as possible. The edge 23 of the permanent magnets 22,24 facing toward the separable contacts 4 and the operating mechanism 6 (FIG. 1) is preferably at about the middle or nearer to the back of the arc splitter plates 28'. The arc splitter plates 28' have a first portion 29 facing the separable contacts 4 (FIG. 1), an opposite second portion 31 and an intermediate portion 33 between the first and second portions. The edge 23 of the permanent magnets 22,24 facing toward the separable contacts 4 (FIG. 1) is between the intermediate portion 33 and the second portion 31.

FIG. 7 shows a simplified plan view of the arc chute 8' of FIG. 2B. This includes the relatively small permanent magnets 22,24 on the ferromagnetic side members 10,16 and the intermediate magnetic portion 64 (e.g., without limitation, carbon steel) between the two composite arc splitter plate portions (e.g., without limitation, a non-magnetic material; copper; a non-magnetic stainless steel) 70,72. The intermediate magnetic portion 64 is about 3 mm wide (e.g., the vertical dimension of FIG. 7). The intermediate magnetic portion 64 and the two composite arc splitter plate portions 70,72 are coupled (e.g., without limitation, welded) to each other along edges 63,65 of the intermediate magnetic portion 64.

Figure 8:
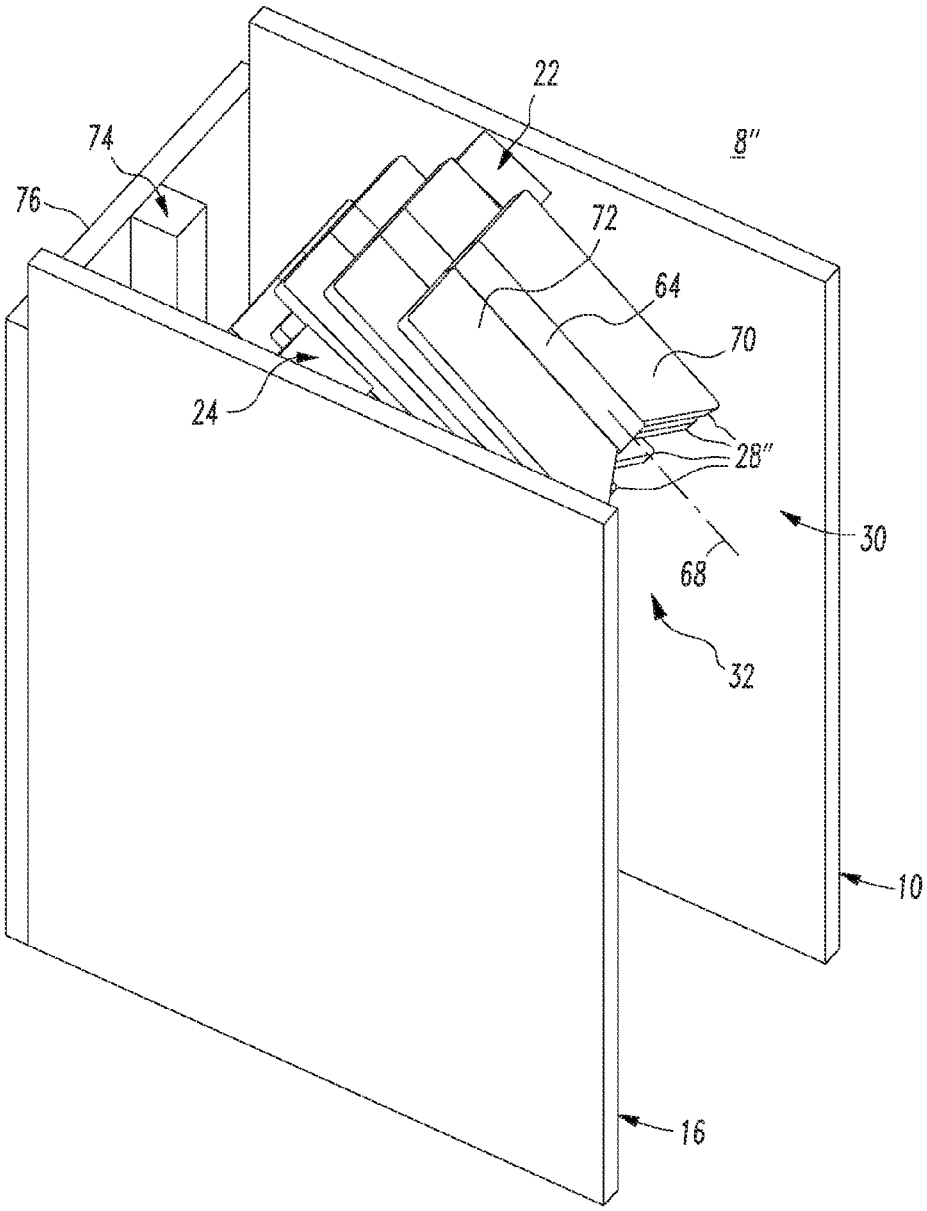
FIG. 8 is an isometric view of an arc chute including relatively small permanent magnets on ferromagnetic side walls, a ferromagnetic back wall and one set of composite arc splitter plates in accordance with an embodiment of the disclosed concept.
Figure 9:
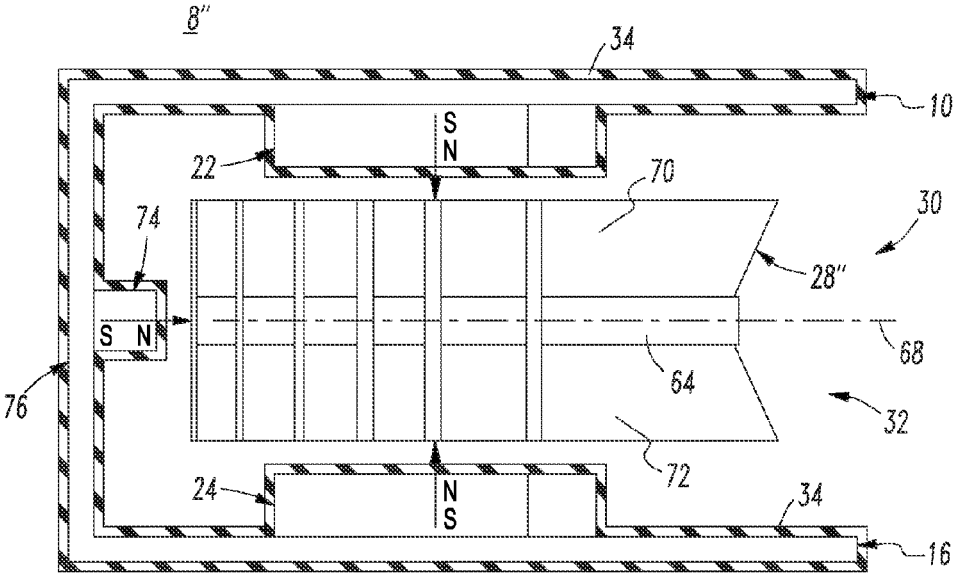
FIG. 9 is a simplified plan view of the arc chute of FIG. 8.

FIGS. 8 and 9 show another arc chute 8" including the relatively small permanent magnets 22,24 on the ferromagnetic side members 10,16 and a third permanent magnet 74 disposed on a ferromagnetic back member 76 disposed between the first and second ferromagnetic side members 10,16, and the composite arc splitter plates 28" (FIG. 7). The permanent magnets 22,24,74 and ferromagnetic members 10,16,76 are covered with electrical insulation 34 to prevent shorting out the arc column. The arc chute 8" contains a single set of the composite arc splitter plates 28", and is divided into the two arc chambers 30,32 formed by the electrically insulative divider 68, which divides the arc splitter plates 28" into the first arc chamber 30 and the adjacent second arc chamber 32. Alternatively, the single set of the arc splitter plates 28' (FIG. 6) can be employed. The ferromagnetic back member 76 faces the two arc chambers 30,32. A magnetic field from the third permanent magnet 74 is orientated in a same direction as a magnetic field at the separable contacts 4 (FIG. 1) in a closed position thereof. This results in an increased magnetic field in the area of the closed separable contacts 4 and there is no magnetic field null point. For example and without limitation, adding the intermediate magnetic portion 64 between the two arc splitter plate portions 70,72 increases this effect.

Figure 10:
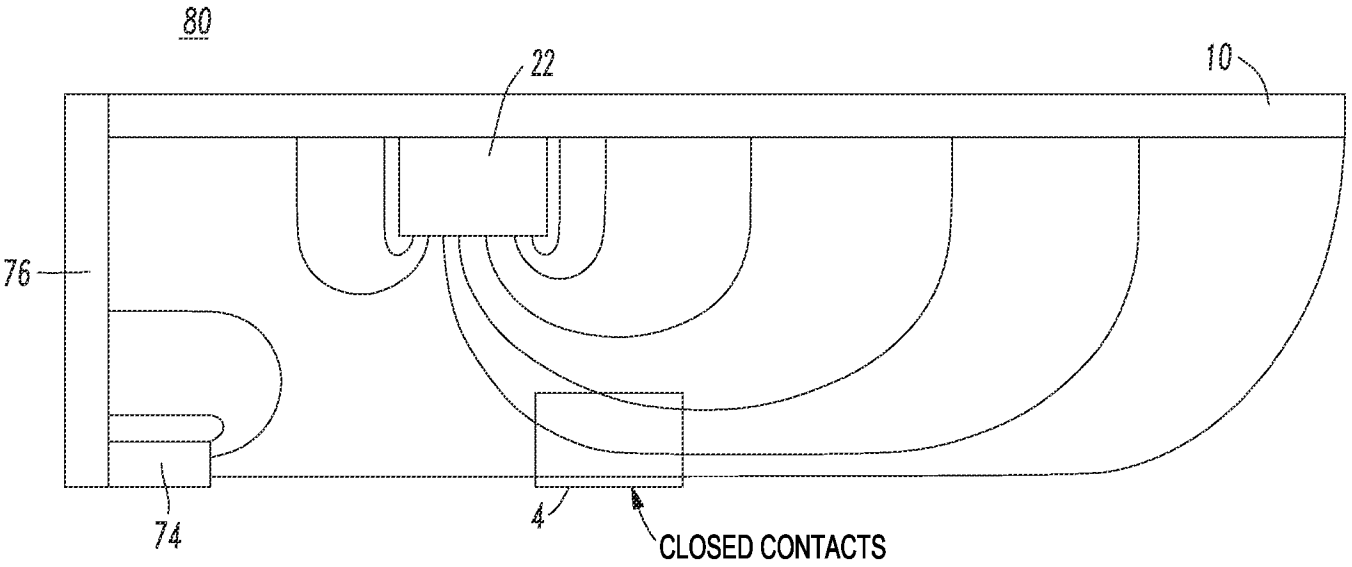
FIG. 10 is a magnetic field plot for the arc chute of FIG. 8 except with non-magnetic arc splitter plates in which there is no magnetic null and no magnetic field reversal in accordance with an embodiment of the disclosed concept.

FIG. 10 shows a magnetic field plot 80 for the arc chute 8" of FIGS. 8 and 9 except that the non-magnetic arc plates 28' (FIG. 2A) are employed. Here, there is no magnetic field null point and no magnetic field reversal at a position behind the separable contacts 4 and distal from the arc plates 28'.

Figure 11:
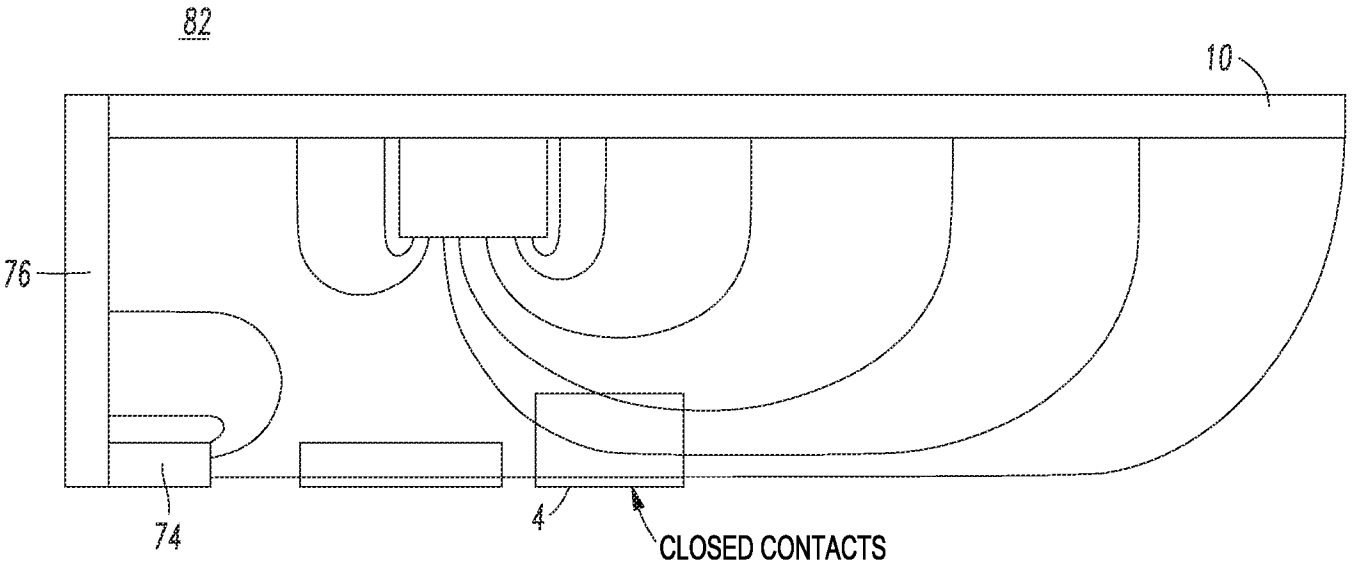
FIG. 11 is a magnetic field plot for the arc chute of FIG. 8 in which there is no magnetic null and no magnetic field reversal.

FIG. 11 shows a magnetic field plot 82 for the arc chute 8" of FIGS. 8 and 9 including the composite arc splitter plates 28" (FIG. 7). Here, again, there is no magnetic null and no magnetic field reversal. Also, the magnitude of the magnetic field is increased near the closed separable contacts 4 (FIG. 1). This improves the orientation of the magnetic field which drives the arc into one of the dual arc chambers 30,32 (FIG. 9) (depending on the current direction) and splits the arc.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus for bi-directional direct current switching and interruption, said electrical switching apparatus comprising:

separable contacts;

an operating mechanism structured to open and close said separable contacts; and an arc chute comprising:

a first ferromagnetic side member having a first side and an opposite second side, a second ferromagnetic side member having a first side and an opposite second side, the first side of said second ferromagnetic side member facing the first side of said first ferromagnetic side member, a first permanent magnet disposed on the first side of said first ferromagnetic side member, a second permanent magnet disposed on the first side of said second ferromagnetic side member, and a single set of a plurality of arc splitter plates disposed between said first and second permanent magnets, wherein said first and second permanent magnets are substantially smaller in size than each of said first and second ferromagnetic side members such that the first permanent magnet is situated along less than about one-half of the first side of the first ferromagnetic side member and the second permanent magnet is situated along less than about one-half of the first side of the second ferromagnetic side member, wherein said arc chute is divided into two arc chambers, and wherein each of the two arc chambers is for a corresponding direction of direct current flow through said separable contacts.

2. The electrical switching apparatus of claim 1 wherein said first and second permanent magnets and said first and second ferromagnetic side members are covered with electrical insulation.

3. The electrical switching apparatus of claim 1 wherein said arc chute further comprises an insulative divider; and wherein said two arc chambers are formed by the insulative divider dividing said arc splitter plates into a first arc chamber and an adjacent second arc chamber of said two arc chambers.

4. The electrical switching apparatus of claim 1 wherein said arc splitter plates are made of a non-magnetic material.

5. The electrical switching apparatus of claim 4 wherein said non-magnetic material is selected from the group consisting of copper and a non-magnetic stainless steel.

6. The electrical switching apparatus of claim 1 wherein each of said arc splitter plates includes two composite arc splitter plate portions and an intermediate magnetic portion therebetween.

7. The electrical switching apparatus of claim 6 wherein said intermediate magnetic portion is made of carbon steel; and wherein said two composite arc splitter plate portions are made from a non-magnetic material selected from the group consisting of copper and a non-magnetic stainless steel.

8. The electrical switching apparatus of claim 7 wherein said intermediate magnetic portion is about 3 mm wide.

9. The electrical switching apparatus of claim 7 wherein said intermediate magnetic portion and said two composite arc splitter plate portions are coupled to each other along edges of said intermediate magnetic portion.

10. The electrical switching apparatus of claim 1 wherein said arc chute further comprises a ferromagnetic back member disposed between said first and second ferromagnetic side members and a third permanent magnet disposed on said ferromagnetic back member facing said two arc chambers; and wherein a magnetic field from said third permanent magnet is orientated in a same direction as a magnetic field at said separable contacts in a closed position thereof.

11. The electrical switching apparatus of claim 10 wherein said third permanent magnet and said first and second permanent magnets cooperate to increase the magnetic field at said separable contacts in the closed position; and wherein said magnetic field at said separable contacts does not form a magnetic field null point at a position behind said separable contacts and distal from said arc splitter plates.

12. The electrical switching apparatus of claim 10 wherein said third permanent magnet and said first and second permanent magnets are covered with electrical insulation.

13. The electrical switching apparatus of claim 10 wherein each of said arc splitter plates includes two composite arc splitter plate portions and an intermediate magnetic portion therebetween.

14. The electrical switching apparatus of claim 1 wherein a magnetic null point and a magnetic field reversal are disposed apart from said separable contacts in a closed position thereof and are disposed further apart from said arc chute.

15. The electrical switching apparatus of claim 1 wherein said separable contacts include a single break contact structure.

16. The electrical switching apparatus of claim 4 wherein said arc splitter plates have a first portion facing said separable contacts, an opposite second portion and an intermediate portion between said first and second portions; and wherein an edge of said first and second permanent magnets on each of said first and second ferromagnetic side members facing toward said separable contacts is between said intermediate and second portions.

17. The electrical switching apparatus of claim 1 wherein said first and second permanent magnets form a magnetic field and force a magnetic field null point and a magnetic field reversal away from said arc chute, and increase a magnitude of the magnetic field proximate said separable contacts in a closed position thereof.

18. The electrical switching apparatus of claim 1 wherein said first and second permanent magnets form a magnetic field that pulls an arc struck between said separable contacts when moving from a closed position thereof toward an open position thereof toward said arc splitter plates regardless of an initial direction of motion of said arc.

19. The electrical switching apparatus of claim 1 wherein said first and second permanent magnets form a magnetic field and are structured to cause the magnetic field to enter one of said first and second ferromagnetic side members and come back into a region of said separable contacts in a closed position thereof from air on one side and from the other one of said first and second ferromagnetic side members on the other side; wherein said first and second permanent magnets are located at a first edge of said first and second ferromagnetic side members distal from said separable contacts; wherein an extension of said first and second ferromagnetic side members toward said separable contacts causes the magnetic field to be directed toward a corresponding one of said first and second permanent magnets; wherein a magnetic null point is located about at an opposite second edge of said first and second ferromagnetic side members distal from said separable contacts; wherein a magnetic field reversal at about the first edge of said first and second ferromagnetic side members causes an arc struck between said separable contacts to stop at said first edge; wherein the magnetic field is increased at about a side of said separable contacts distal from the opposite second edge of said first and second ferromagnetic side members in a closed position of said separable contacts; and wherein the magnetic field causes the arc to move toward said arc splitter plates.

20. An electrical switching apparatus for bi-directional direct current switching and interruption, said electrical switching apparatus comprising:

a set of separable contacts;

an operating mechanism structured to open and close said set of separable contacts; and an arc chute comprising:

a first ferromagnetic side member having a first side and an opposite second side, a second ferromagnetic side member having a first side and an opposite second side, the first side of said second ferromagnetic side member facing the first side of said first ferromagnetic side member, a first permanent magnet situated at the first side of said first ferromagnetic side member, a second permanent magnet situated at the first side of said second ferromagnetic side member, and a single set of a plurality of arc splitter plates disposed between said first and second permanent magnets, each arc splitter plate of the plurality of arc splitter plates including a pair of composite arc splitter plate portions and an intermediate magnetic portion situated therebetween, wherein said arc chute comprises two arc chambers, and wherein each of the two arc chambers is for a corresponding direction of direct current flow through said separable contacts.

* * * * *